US005183114A

United States Patent [19]

Mashaw, Jr. et al.

[11] Patent Number: 5,183,114

[45] Date of Patent: Feb. 2, 1993

[54] SLEEVE VALVE DEVICE AND SHIFTING TOOL THEREFOR

[75] Inventors: Howard R. Mashaw, Jr., Carrollton; Robert C. Hammett, Garland, both of Tex.

[73] Assignee: Otis Engineering Corporation, Dallas, Tex.

[21] Appl. No.: 678,812

[22] Filed: Apr. 1, 1991

[51] Int. Cl.[5] ..... E21B 34/10

[52] U.S. Cl. ..... 166/319; 166/332

[58] Field of Search ..... 166/319, 323, 325, 332, 166/123, 181, 386

[56] References Cited

U.S. PATENT DOCUMENTS

| | | | |
|---|---|---|---|
| 3,051,243 | 8/1962 | Grimmer | 166/224 |
| 3,211,232 | 10/1965 | Grimmer | 166/194 |
| 3,552,718 | 1/1971 | Schwegman | 166/332 X |
| 4,603,740 | 8/1986 | Edwards et al. | 166/323 X |
| 4,917,191 | 4/1990 | Hopman et al. | 166/381 |
| 4,928,770 | 5/1990 | Murray | 166/385 |
| 4,928,772 | 5/1990 | Hopman | 166/386 |
| 4,979,561 | 12/1990 | Szarka | 166/240 |

OTHER PUBLICATIONS

"Operation and Utilization of Hydraulic-Actuated Service Tools for Reeled Tubing" by Fowler, Jr. and Pleasants, Society of Petroleum Engineers paper SPE 20678, Sep. 23, 1990.

*Primary Examiner*—Terry Lee Melius

*Attorney, Agent, or Firm*—Roland O. Cox

[57] ABSTRACT

Disclosed is a sliding sleeve valve and a selective pressure operated shifting tool engageable in the selected sleeve valve for shifting the valve sleeve between open and closed positions. The sleeve valve is connectible in a well conduit and is especially useful in highly deviated and horizontal wells. The sleeve valve has a longitudinal flow passage through, centralizers for centralizing the valve in well conduits, longitudinal flow slots on the valve body and ports connecting the flow slots and flow passage. The pressure operated shifting tool is connected to reeled tubing by a quick disconnect. The shifting tool includes an invertible shifting module which may be inverted to shift the valve sleeve to closed or open position. The shifting tool keys are locked retracted for running and on complete shifting of the sleeve are automatically released from the valve sleeve and returned to locked retracted position for retrieving. Complete shifting of the sleeve is signaled by circulation down reeled tubing back to surface. The shifting tool also includes a section which may be operated to retract and release the shifting tool keys from the valve sleeve if the sleeve is not completely shifted.

33 Claims, 7 Drawing Sheets

SLEEVE VALVE DEVICE AND SHIFTING TOOL THEREFOR

BACKGROUND OF THE INVENTION

1. Field of the Invention

This invention pertains to a sleeve valve useful in a well conduit and a selective pressure operated shifting tool which will locate in the sleeve valve and open the sleeve valve for flow between the outside and inside of the valve or close the sleeve valve to flow.

2. Description of Related Art

When completing a deviated earth well for production, it is known to use a number of the same well tools such as sliding sleeve valves spaced apart in the well conduit. Other known well tools may or may not be interspersed between the sleeve valves in the conduit. During the course of well completion and production, it may be desirable to operate the sleeve valves to be opened or closed in sequence from top to bottom or bottom to top of the conduit, or to open or close a particular sleeve valve selected from the group of sleeve valves.

Each sleeve valve is usually selectively opened to establish a flow path between the interior and exterior of the sleeve valve or closed by engaging a shifting tool in a sliding sleeve in the sleeve valve for movement of the sliding sleeve between open and closed positions. It is also known to lower such shifting tools into deviated wells on jointed or continuous lengths of reeled tubing to supply sufficient weight, especially in the non-vertical well sections, for proper operation of sleeve valves in the conduit.

SUMMARY OF INVENTION

The present invention provides a sleeve valve for use in a well conduit and a selective pressure operated shifting tool which is lowered into the sleeve valve on a continuous length of reeled tubing or smaller tubing for shifting the sleeve valve to open or closed position. The sleeve valve was particularly designed for use in the horizontal section of a deviated well and will operate as well as in the vertical section of a well. The sleeve valve includes upper and lower housings each having a centralizer, slotted for flow, to centralize the sleeve valve when used in the deviated section of a well. The lower housing also includes a number of ports for flow between the outside and inside of the sleeve valve when in open position. Each port is aligned with an elongated flow slot and lower centralizer flow slot. The lower housing and flow slots may be made any length required to extend the complete width of the horizontal producing formations for collection and direction of production to the sleeve valve ports. The invention sleeve valve has a locator recess in the upper valve housing in which the shifting tool selectively locates on being lowered into the valve and an internal sleeve which on being shifted upwardly to open position, opens the ports for flow. The sleeve also has upper and lower internal recesses for engagement by keys on the shifting tool and upper and lower seals for sealing across the sleeve ports when the sleeve is in the down closed position. The pressure operated shifting tool is connected to reeled tubing by a quick disconnect which may be operated by dropping a ball and pressuring down the reeled tubing to disconnect the reeled tubing from the shifting tool if the need arises anytime after the shifting tool has engaged the sliding sleeve valve sleeve.

The selective pressure operated shifting tool assembly includes the emergency disconnect disclosed in U.S. Pat. No. 4,986,632 to Charles W. Pleasants, herein incorporated for reference, the releasable locator tool of U.S. Pat. No. 4,896,721 to William R. Welch, herein incorporated for reference, an invertible shifting module for shifting the sleeve to open or closed position and a two-way valve. The shifting module has keys mounted on a piston which are releasably retained in a retracted position on the shifting tool as the assembly is lowered into the well to engage an internal sleeve recess for opening or closing the sleeve valve. The retracted keys assure free passage of the shifting tool assembly through any tools in the well conduit which may be inadvertently operated by passage of the shifting tool.

The selective releasable locator has keys which engage locator recesses in the upper valve housing and locate the shifter module keys adjacent either the upper or lower sleeve internal recess for shifting the sleeve. The shifter module may be inverted for shifting the sleeve upwardly to open or downwardly to close.

The two-way valve on the lower end of the shifter assembly permits fluid to flow into a flow passage through the shifter assembly and into reeled tubing as they are lowered into the well. When the shifting tool assembly is located in the sleeve valve and reeled tubing is pressurized, the two-way valve closes to permit pressurized fluid to be delivered into the key carrying piston on the shifting module. Pressure in the reeled tubing will move the piston on the shifting module to release shifting keys from retracted position to engage one of the sleeve recesses for shifting the sleeve. Complete shifting of the internal sleeve is indicated by a drop of pressure in the reeled tubing and circulation back to surface. If complete shifting of the sleeve is indicated, the shifting keys automatically release from the sleeve recess and are automatically returned to and retained in retracted position for retrieval from the well. The shifting tool assembly may now be retrieved back to surface by pulling sufficiently on the reeled tubing to release the releasable locator from engagement with the locator recesses in the sleeve valve.

If the shifting tool assembly does not completely shift the sleeve or cannot be released from the sleeve valve, the shifting tool may be operated to retract and release the keys from the sleeve recess. The shifting tool keys are mounted on an operating section of the shifting tool assembly and may be operated to retract and release from the sleeve recess the same as the sleeve shifter disclosed in U.S. Pat. No. 3,874,634 to Gazda. The '634 patent is incorporated herein for reference.

If the shifting tool assembly cannot be retrieved on reeled tubing, the quick disconnect may be operated by applying sufficient pressure in the reeled tubing to open the two-way valve and permit a ball to be pumped down reeled tubing to operate the quick disconnect and disconnect the reeled tubing from the shifting tool for retrieval to surface.

OBJECTS

An object of this invention is to provide a sliding sleeve valve for use in deviated and horizontal wells having upper and lower centralizers and elongated flow slots for enhancing flow from outside the sleeve valve through open ports in the sleeve valve to inside the sleeve valve.

Another object of this invention is to provide a pressure operated shifting tool for running on reeled tubing, which is engageable in the sliding sleeve valve for opening or closing the sleeve valve to flow.

Also an object of this invention is to provide a pressure operated shifting tool which holds shifting keys retracted while the shifting tool is being run.

Another object of this invention is to provide a pressure operated shifting tool which will automatically release from the sliding sleeve valve and automatically retract shifting keys and retain them in retracted position for retrieval on complete opening or closing of the sleeve valve.

Also an object of this invention is to provide a shifting tool which can be operated to release from the sleeve valve if sleeve valve opening or closing is not complete.

Another object of this invention is to provide a pressure operated shifting tool from which reeled tubing may be disconnected if the shifting tool cannot be released or retrieved from the sleeve valve on reeled tubing.

DESCRIPTION OF THE PREFERRED EMBODIMENT

Figure 1:
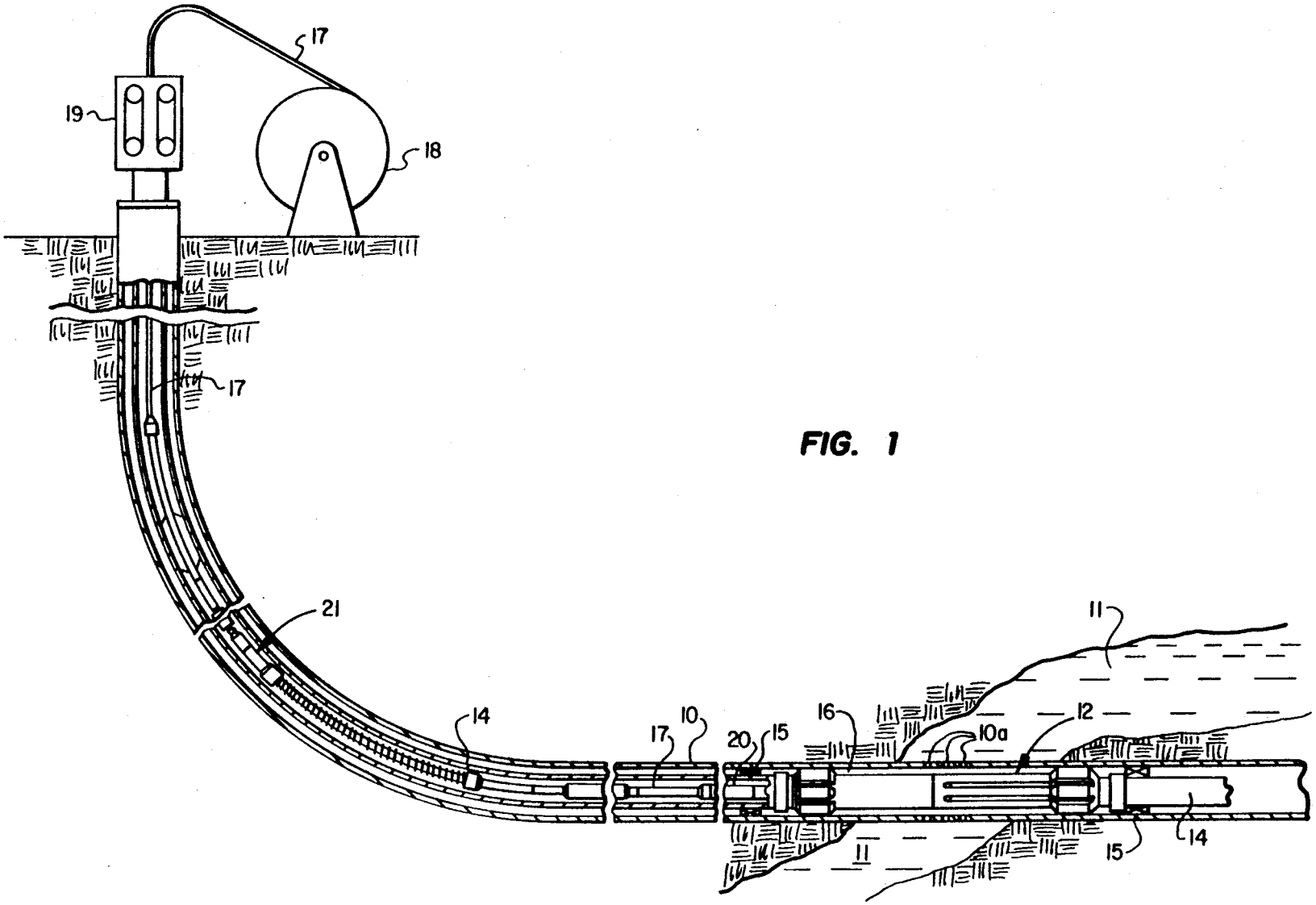
FIG. 1 is a partially sectioned schematic view of a deviated earth well having a horizontal section and showing the system of the present invention installed in the well casing.

FIG. 1 shows a deviated earth well having casing 10 passing through a formation 11. Perforations 10*a* have been formed through the casing for flow between the formation and inside of the casing. A sliding sleeve valve assembly 12 is connected in production tubing 14 and two axially-spaced packers 15 anchor the tubing and seal it to the casing, forming a sealed annular space 16 and isolating perforations 10*a* from other perforations (not shown) which may be formed through the casing.

Reeled tubing 17 is stored on reel 18 on the surface and is injected into or withdrawn from the well tubing by injector 19. There is sufficient auxiliary equipment on the surface (not shown) to pump fluid into and through the reeled tubing.

FIG. 1 also shows the pressure operated shifting tool of this invention 20 has been connected to a work string 21 which has been connected to reeled tubing 17. The shifting tool and work string have been run into production tubing 14 through injector 19 until the shifting tool has located in sliding sleeve valve assembly 12 to open or close the sleeve valve.

Figure 2A:
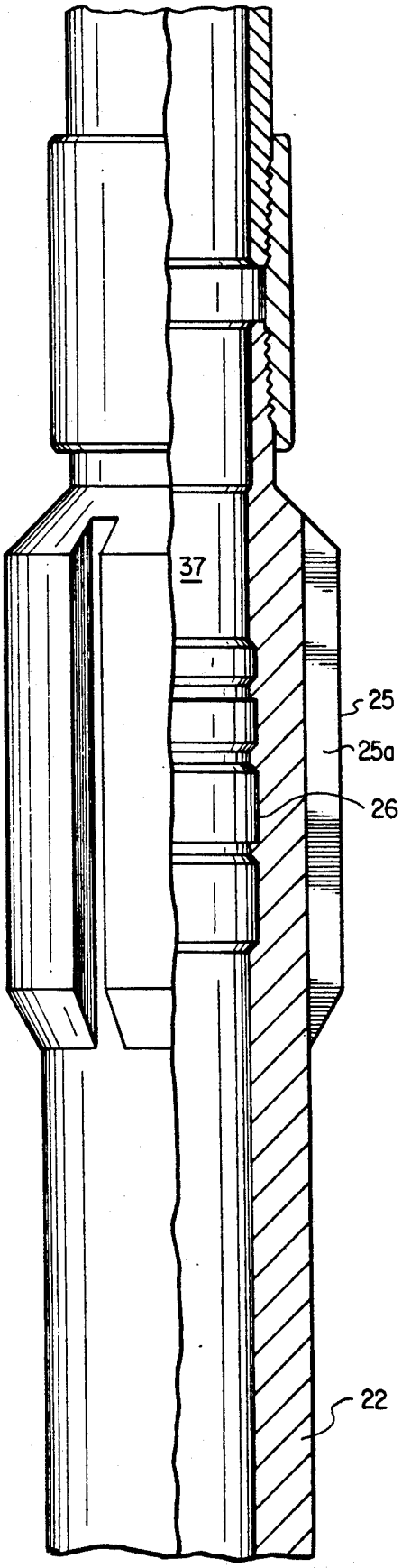
FIGS. 2A, 2B and 2C together are a sectioned drawing in elevation of the sliding sleeve valve of this invention in open position.
Figure 2B:
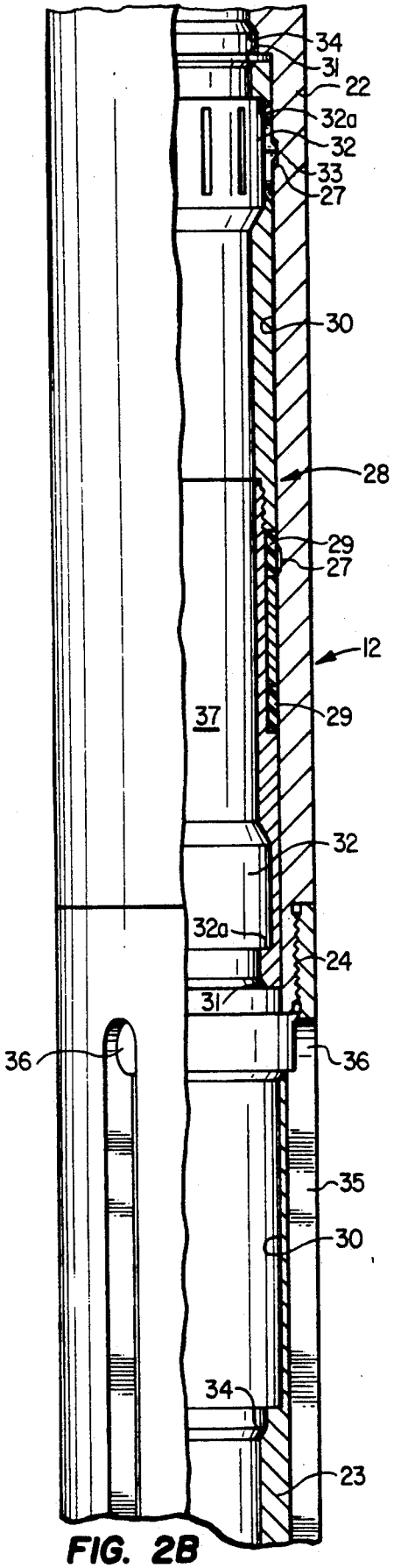
Figure 2C:
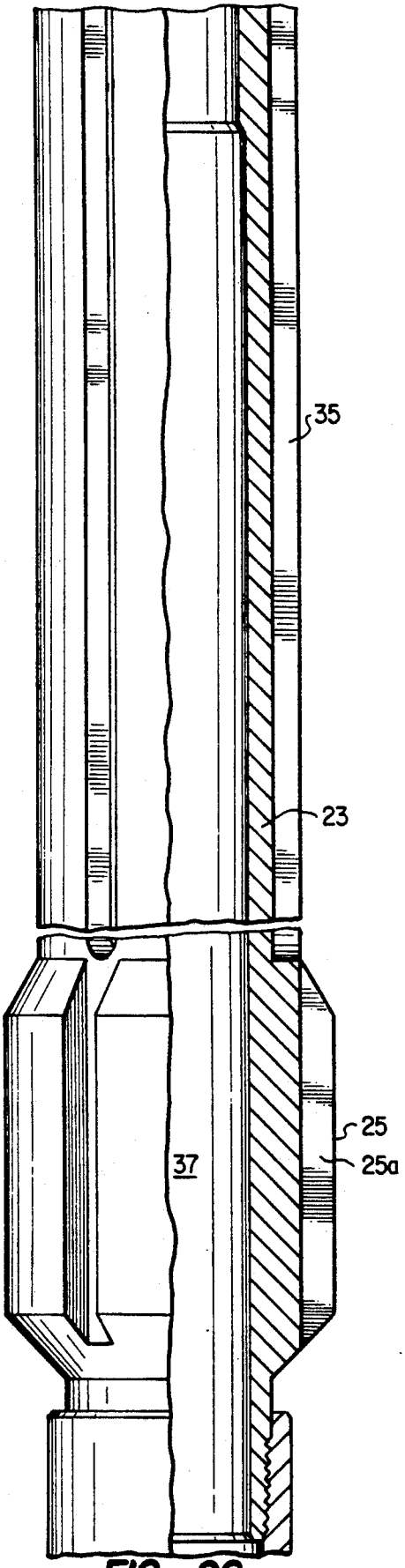
Figure 4A:
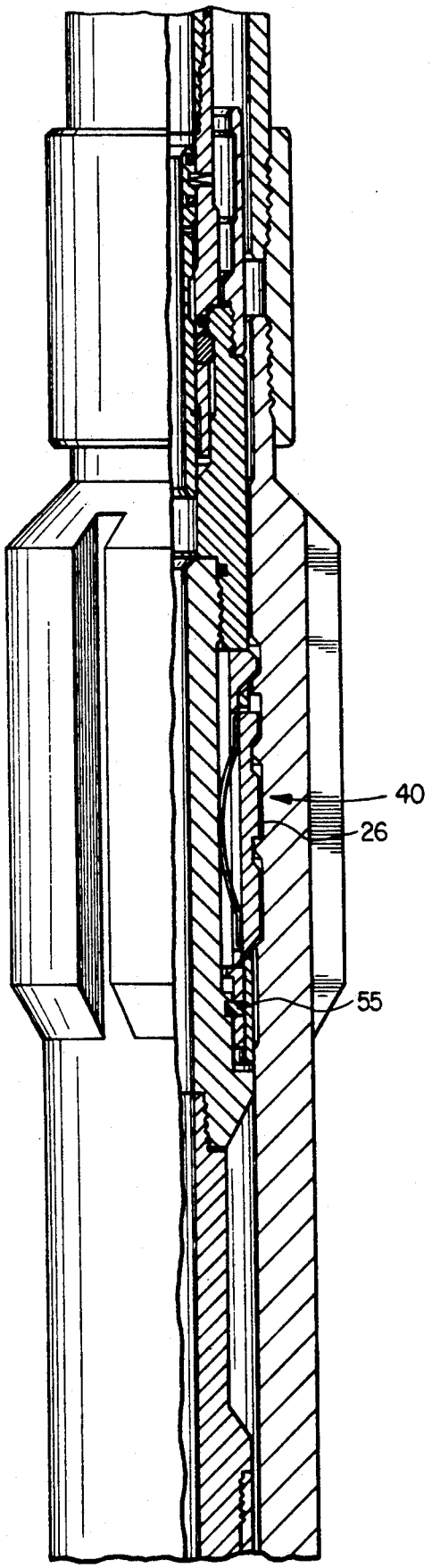
FIGS. 4A, 4B and 4C together are a drawing similar to FIGS. 3A, 3B and 3C showing the shifting tool after operation to shift the sleeve valve to closed position.
Figure 4B:
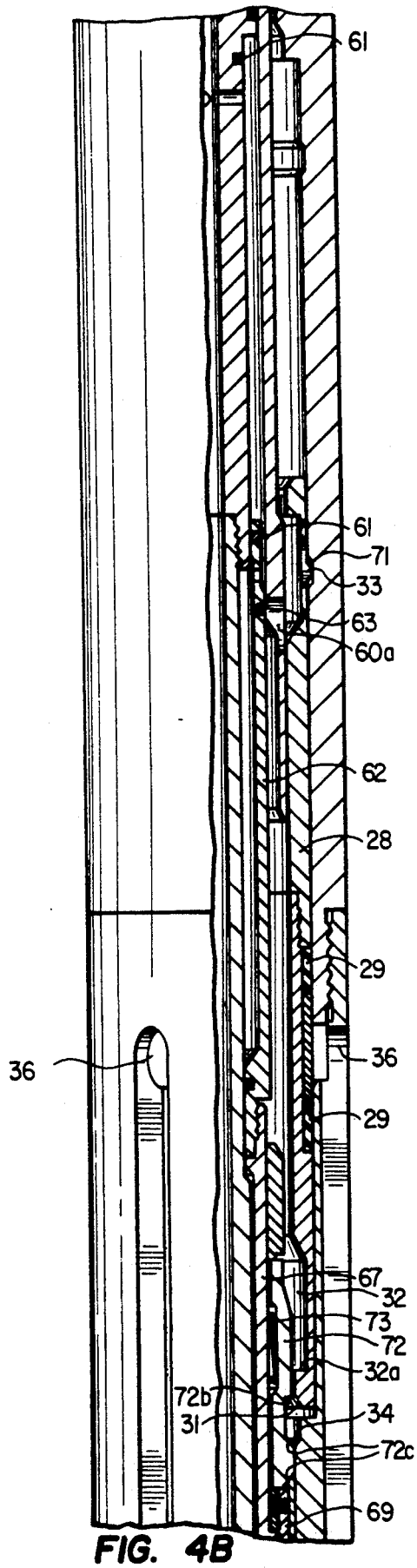
Figure 4C:
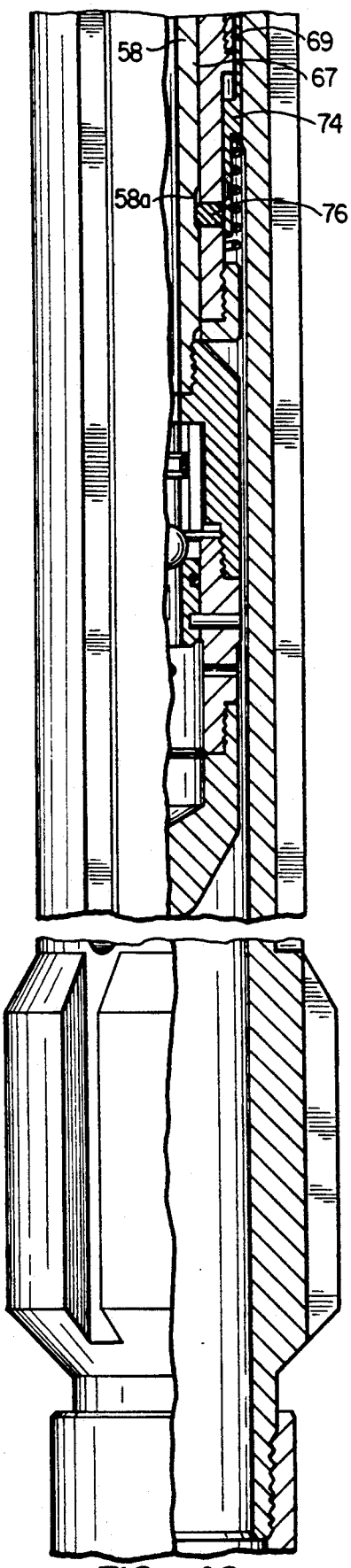

Referring to FIG. 2, the sliding sleeve valve assembly 12 includes an upper tubular housing 22 and a lower tubular housing 23 which are sealed and connected together at thread 24. Around the upper housing is a centralizer 25 with a number of flow slots 25*a*. A number of selective locating recesses 26 and upper and lower positioning grooves 27 have been formed in the upper housing. A valve sleeve 28 is slidably mounted and sealed with seals 29 in seal bore 30, which also extends into the upper end of lower housing 23. The valve sleeve has upper and lower camming surfaces 31 and shifting recesses 32 each with a shifting surface 32*a*. Valve sleeve 28 also has biased lugs 33 which engage upper positioning groove 27 to retain the valve sleeve in open position as shown in FIG. 2 or lugs 33 engage lower positioning groove 27 to retain the valve sleeve in closed position as shown in FIG. 4. The upper and lower housings each have like camming surfaces 34.

Around the lower tubular housing is a lower centralizer 25 having a number of flow slots 25*a*. Aligned with each flow slot is a longitudinal flow slot 35 of equal width formed partially through the lower housing. Ports 36 extend between slots 35 and the inside of the sleeve valve housing. There is a longitudinal flow passage 37 through sleeve valve 12.

Figure 3A:
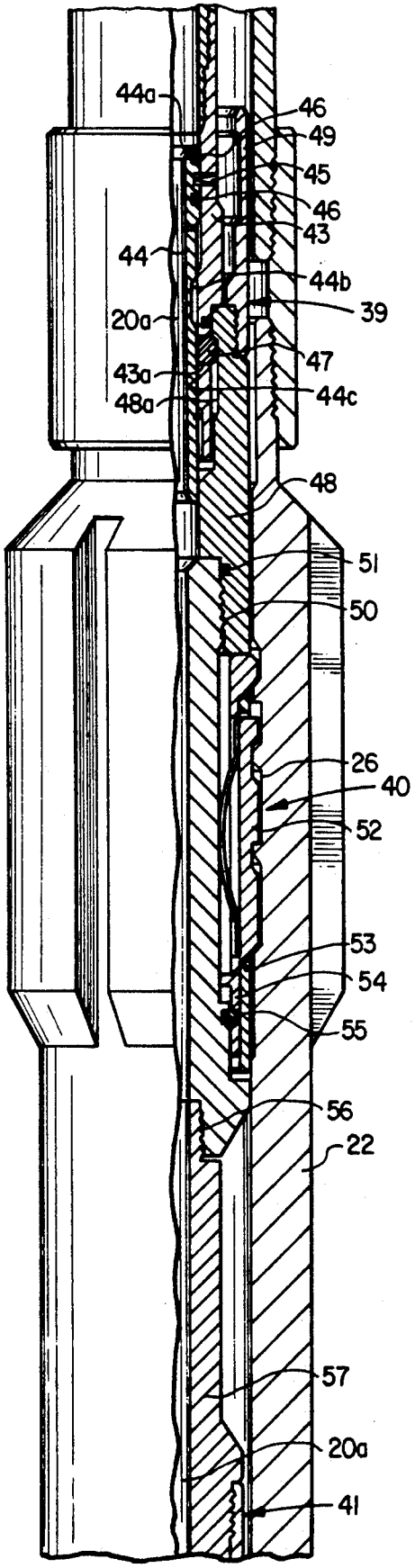
FIGS. 3A, 3B and 3C together are a partially sectioned longitudinal view of the pressure operated shifting tool assembly of this invention located in the sleeve valve of FIG. 2A–C.
Figure 3B:
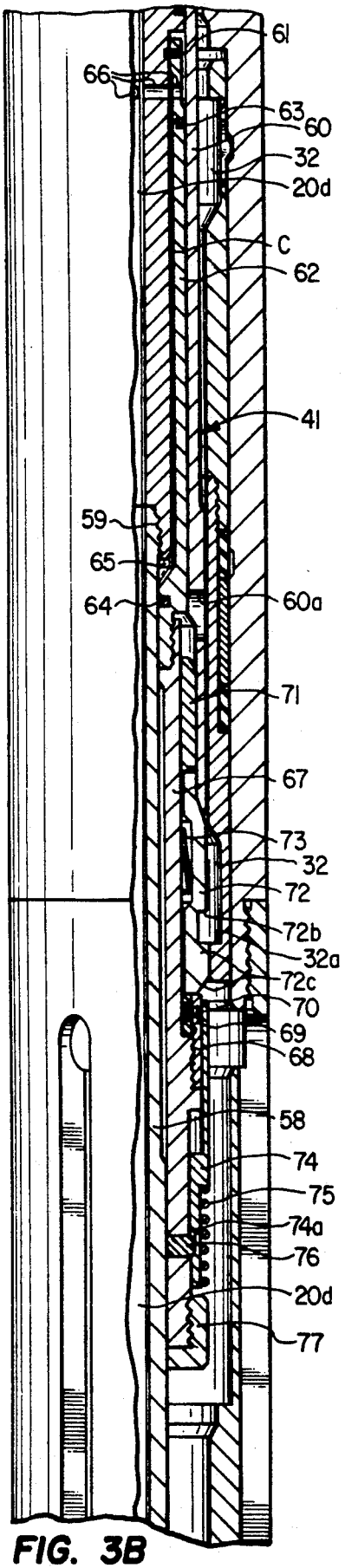
Figure 3C:
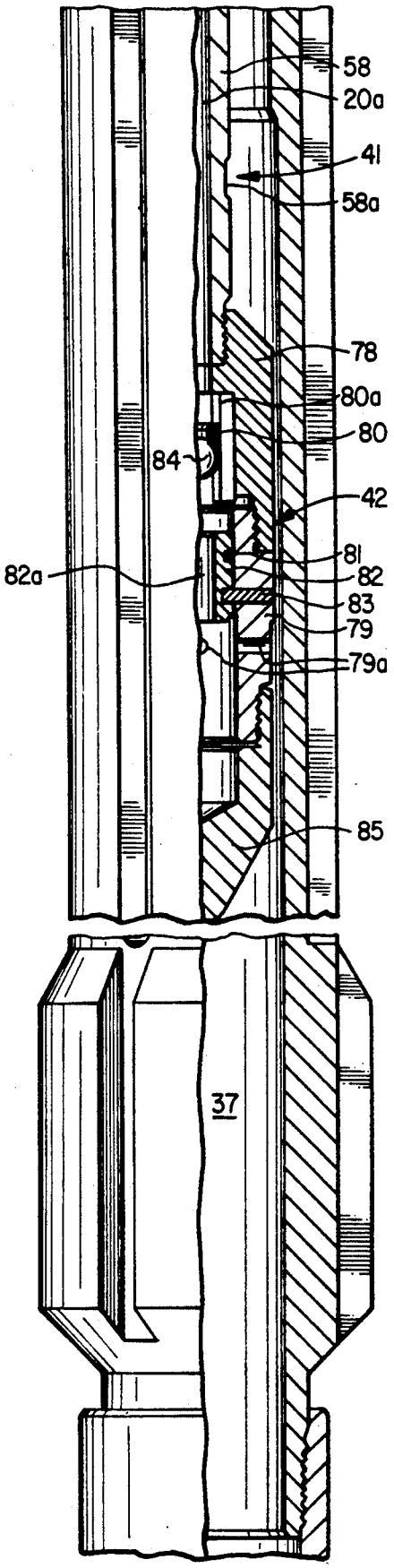

The pressure operated selective shifting tool assembly 20 of this invention, as shown in FIG. 3, has a flow passage 20*a* and includes an emergency disconnect assembly 39 disclosed in previously incorporated U.S. Pat. No. 4,986,362 and connected to reeled tubing, the releasable locator 40 of U.S. Pat. No. 4,896,721, an invertible shifting module 41 and a two-way valve assembly 42.

The emergency disconnect assembly 39 releasably connects the reeled tubing 17 to releasable locator 40. Disconnect assembly 39 includes a mandrel 43, a sleeve 44 releasably positioned in the mandrel by shearable pin 45 and slidably sealed in the mandrel by seals 46 above and below the pin. The mandrel is connectible to reeled tubing and has openings 43*a* in which are mounted radially moveable lugs 47. Sleeve 44 has a seat 44*a*, a groove 44*b* and expanding surface 44*c*. The disconnect body 48 has an internal groove 48*a*, an internal fishing neck 49 connected on its upper end, is sealably connected to releasable locator 40 at 50 and sealed to the mandrel with seal 51. The disconnect mandrel and body are locked connected as shown in FIG. 3 by sleeve expander surface 44*c* holding lugs 47 expanded into body groove 48*a*.

FIG. 3 also shows keys 52 on releasable locator 40 have engaged selective locator recesses 26 in the sleeve valve housing 22 to locate shifting tool 20 in the sleeve valve to close the sleeve valve. Keys 52 extend through openings in key mandrel 53. The keys are held in position extending through the key mandrel openings by sleeve 54, which is releasably positioned by shearable pin 55.

Invertible shifting module 41 is sealably connected to locator 40 at 56, as shown in FIG. 3. The shifting module has upper and lower mandrels 57 and 58 sealably connected at 59. The lower mandrel has a groove 58*a*. Connected and sealed around the upper housing is a tubular cover 60 having openings 60*a*. Releasably positioned by shearable pin 61 in the cover is a piston 62, which is slidably mounted around the upper and lower mandrels. The piston is slidably sealed to the cover with seal 63 and to the lower mandrel with seal 64 forming a variable volume pressure chamber 65. There are openings 66 in the upper mandrel and piston for pressure communication between shifting tool flow passage 20*a* through openings 66 and clearance C between the outside of the upper mandrel and inside of the piston to chamber 65.

Figure 6:
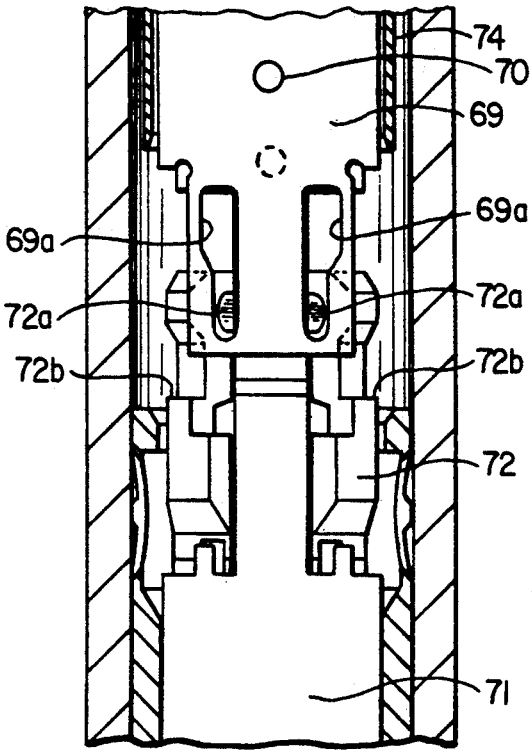
FIG. 6 is a drawing in elevation of a portion of the shifting tool shown operated for emergency release from the sliding sleeve valve.

Connected to the piston is an extension 67. Connected on the piston extension at 68 is a retracting sleeve 69 (See also FIG. 6). Slidably mounted on the piston extension and releasably connected to the retracting sleeve by shareable pin 70 is a key retainer 71. Each key 72 is urged radially outward by a spring 73 and each key has a shifting surface 72*b* and ears 72*a* which extend into retracting slots 69*a* on retracting sleeve 69. Keys 72 include opposed camming surfaces 72*c*. Slidably mounted around the retracting sleeve and piston extension is a lock sleeve 74, which has an internal groove 74*a*. A spring 75 around the lock sleeve has been compressed by moving the lock sleeve down. The lock sleeve is releasably positioned down by radially moveable lugs 76 held engaged in lock sleeve groove 74*a* by the outer surface on lower mandrel 58. A guide 77 is connected on the lower end of the piston extension.

Sealably connected on the lower end of lower mandrel 58 is two-way valve 42. The two-way valve comprises an upper housing 78 sealably connected to a lower housing 79, which has openings 79*a*. Positioned in the upper housing is a ball retainer 80 which has a flow passage 80*a*. Slidably sealed in the lower housing with seal 81 is a ball seat 82, which has a longitudinal flow passage 82*a*. This seat is releasably positioned in the housing with shearable pin 83 and is sealingly engageable by valve ball 84. A guide cap 85 is connected on lower housing 79. Flow may occur between the outside of two-way valve 42 and inside of the pressure operated shifting tool through lower housing openings 79*a*, seat flow passage 82*a* and ball retainer flow passage 80*a*.

To use the pressure operated shifting tool 20 of this invention to shift valve sleeve 28 of the invention sleeve valve assembly 12 downwardly to closed position, position shift module 41 for down shifting as shown in FIG. 3 and connect the shifting tool quick disconnect mandrel 43 to reeled tubing. Shifting keys 72 are locked in the retracted position for running by cover 60. Reeled tubing carrying shifting tool 20 is run through injector 19 down production tubing until releasable locator 40 engages selective locator recesses 26 in the sleeve valve and stops downward movement of the shifting tool and reeled tubing. The shifting tool and reeled tubing fills through two-way valve flow passages 79*a*, 82*a* and 80*a* as they are being lowered in the production tubing. Pressure applied to reeled tubing at the surface acts downwardly through reeled tubing and into shifting tool passage 20*a* to sealingly engage two-way valve ball 84 with seat 82 closing the two-way valve. Now, pressure in the shifting tool acts through openings 66 in upper mandrel 57 and piston on seal 63 and through clearance C into chamber 65 and on seal 64. Increasing pressure in reeled tubing shears pin 61 and moves piston 62, extension 67, and sleeve 69 downwardly. Downward movement of sleeve 69 moves keys 72 from inside cover 60 and permits compressed springs 73 to move the keys outwardly into engagement with the lower shifting recess 32 in sleeve valve sleeve 28. Continued downward movement of keys 72 engages shifting surface 72*b* with sleeve recess shifting surface 32*a* and moves sleeve 28 to closed position where upper and lower seals 29 close ports 36 to flow and biased lugs 33 in lower positioning groove 27 retaining the sleeve in closed position—see FIG. 4.

FIG. 4 shows sleeve 28 has been moved completely downward with the key opposed camming surfaces engaging camming surfaces 31 and 34 and lower sleeve camming surface 31 has moved close enough to lower housing camming surface 34 to cam the keys inwardly disengaging key shifting surfaces 72*b* from sleeve shifting surface 32*a* and releasing the keys from sleeve recess 32. Also shown in FIG. 4, the piston extension has moved downward along lower mandrel 58 until lugs 76 were adjacent mandrel groove 58*a*, compressed spring 75 has cammed the lugs into groove 58*a* and released lock sleeve 74 to move upwardly to engage and lock the keys in retracted position and cam lugs 76 into mandrel groove 58*a*, locking the piston extension to mandrel 58. If the sleeve is shifted completely down and the keys release from the sleeve shifting recess, as shown in FIG. 4, seal 63 on the piston will be moved below openings 60*a* in the cover and establish a flow path for pumping down reeled tubing and return back to surface. Fluid pumped down reeled tubing into shifting tool passage 20*a* will sealingly engage two way valve ball 84 with seat 82 and flow through openings 66 in the piston 62, down through clearance between the piston and cover 60, and through openings 60*a* in the cover. Flow back to surface from openings 60*a* will occur through clearances between the outside of the shifting tool and inside of the sleeve valve assembly and the annular area between reeled tubing and production tubing.

Flow back to surface is an indication of complete sleeve shifting and proper shifting tool release. If flow back to surface after pumping down reeled tubing does not occur, the sleeve has not shifted completely and/or released. If the shifting tool is shifting the sleeve valve sleeve downwardly as shown in FIGS. 3 and 4, the shifting tool may be retrieved to surface by pulling on the reeled tubing with sufficient force to shear releasable locator pin 55 and operate the releasable locator 40 to release as described in detail in incorporated U.S. Pat. No. 4,986,632. Operation of the releasable locator will permit shifting tool 20 to be raised out of sleeve valve 12 lifting key shifting surface 72*b* from shifting recess surface 32*a* and retracting the key from the recess.

Figure 5A:
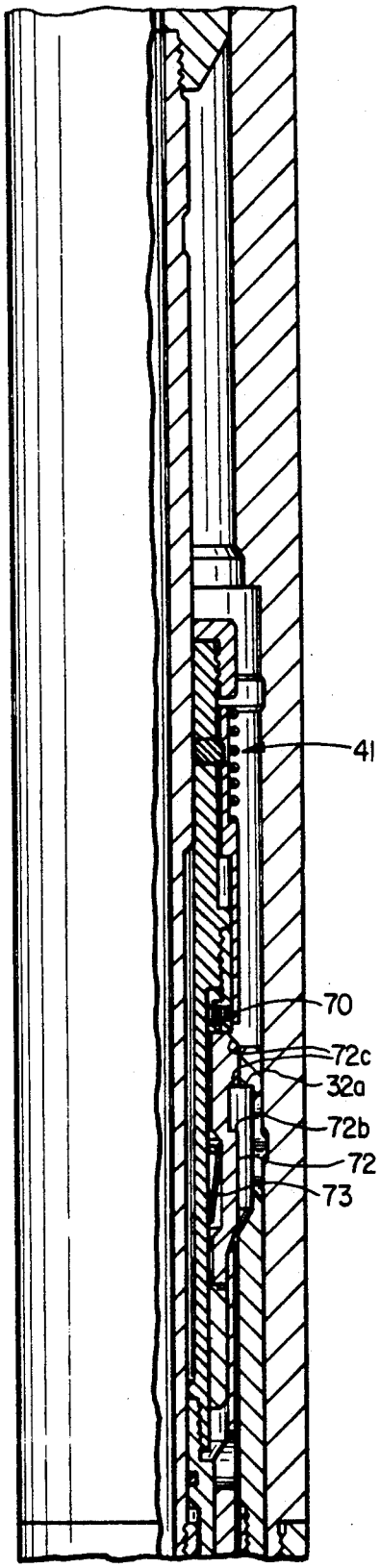
FIGS. 5A and 5B together are a sectioned drawing in elevation of a portion of the invention shifting tool inverted for shifting the sleeve valve to open position.
Figure 5B:
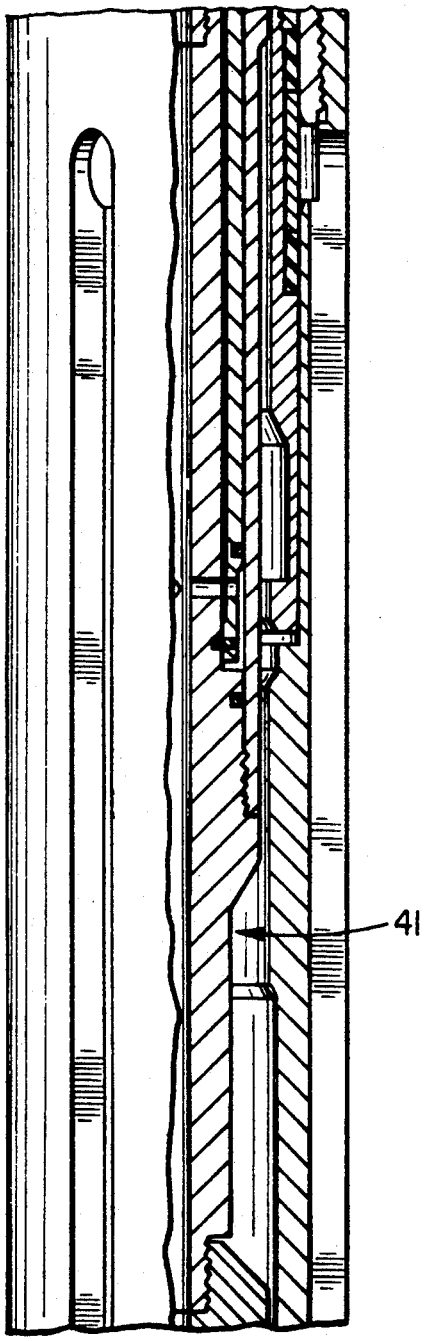

If the shifting tool shift module 41 has been inverted to shift the sleeve valve sleeve upwardly (FIG. 5) and the sleeve cannot be shifted completely or does not retract the shifting keys to release the shifting tool keys from the upper shifting tool recess, key 72 cannot be lifted from recess 32 as spring 73 will move surface 72*b* to engage surface 32*a*. In order to release keys 72 and shifting tool 20 from valve sleeve 28 and sleeve valve assembly 12, reeled tubing must be pulled on to shear releasable locator pin 55 and pin 70 simultaneously. Further upward movement of shifting tool 20 and piston extension 67 will operate releasable locator 40 to release from selective locator recesses 26 and retract and release keys 72 from upper sleeve recess 32 permitting tool 20 and the reeled tubing to be retrieved to surface. Keys 72 are operated to retract and release from upper sleeve recess 32 as disclosed in previously incorporated U.S. Pat. No. 3,874,634.

At any required time after shifting tool 20 engages sliding sleeve valve 12 to open or close the sleeve valve, disconnect assembly 39 may be operated to disconnect the reeled tubing from shifting tool 20. Sufficient pressure must first be applied in reeled tubing at surface to act down the reeled tubing and shifting tool to sealingly engage two-way valve ball 84 with seat 82, shear pin 83 and move the seat and seal 82 below openings 79*a* in lower valve housing 79, opening a flow path between shifting tool passage 20*a* and sleeve valve passage 27 through openings 79*a*. A ball (not shown) may now be introduced into reeled tubing at surface and pumped down reeled tubing to sealingly engage disconnect sleeve seat 44*a*. Increasing pressure in reeled tubing will shear pin 45 and move sleeve groove 44*b* adjacent lugs 47. When reeled tubing is pulled, disconnect mandrel 43 will cam lugs 47 into groove 44*b* and release mandrel 43 from disconnect body 48 for retrieval of reeled tubing and mandrel 43 back to surface.

What is claimed is:

1. A sliding sleeve valve for use in horizontal and highly deviated well conduits comprising:

(a) tubular housing means having a longitudinal through flow passage; said housing means including means thereon for centralizing said sliding sleeve valve within a well conduit, said centralizing means including radial projections on the exterior of the tubular housing intermediate the ends thereof, and flow passages separating said radial projections;

(b) means for attaching said tubular housing means in a well conduit;

(c) longitudinal flow slots on the exterior of said tubular housing means intermediate the ends thereof;

(d) ports extending between said longitudinal flow slots and said longitudinal through flow passage for flow therebetween, each said port aligned with a flow slot; and (e) means for controlling flow through said ports.

2. A sliding sleeve valve as defined in claim 1 wherein the tubular housing means comprises:

(a) an upper housing having selective locator recesses and a seal bore therein, said seal bore having upper and lower positioning grooves therein, said upper housing connected to (b) a lower housing having a seal bore therein.

3. The sliding sleeve valve of claim 2 having radial projections on the upper housing and radial projections on the lower housing, each said projection separated by flow passages and each of said lower projection flow passages are aligned with a longitudinal flow slot and a port in said lower housing.

4. A sliding sleeve valve as defined in claim 2 wherein the means for controlling fluid flow through the ports comprises:

(a) a valve sleeve slidably and sealably mounted in the upper and lower housing seal bores, said valve sleeve being longitudinally moveable on engagement by a pressure operated shifting tool between open position permitting flow through the ports and closed position closing said ports to flow; and (b) releasable means for retaining said valve sleeve in open or closed position.

5. A sliding sleeve valve as defined in claim 4 wherein the releasable means are biased lugs on the valve sleeve engageable in the upper or lower positioning grooves in the upper housing.

6. A sliding sleeve valve as defined in claim 1 wherein the means for attaching the tubular housing means in the well conduit comprises threaded connections on each end of said tubular housing means.

7. A sliding sleeve valve as defined in claim 1 wherein the longitudinal slots in the housing means are of sufficient number, width and length to collect production from a number of well formations.

8. A shifting tool for opening and closing a sliding sleeve valve disposed at a downhole location within a well conduit having a production tubing string therein comprising:

(a) a longitudinal flow passage in the shifting tool;

(b) means for attaching the shifting tool to a reeled tubing string to allow pressure communication between the reeled tubing string and the shifting tool flow passage;

(c) the outside diameter of the shifting tool selected to allow passage of the shifting tool and reeled tubing through the well flow conductor;

(d) invertible operating means having a plurality of keys thereon for use in engaging and opening or closing the sliding sleeve valve including, pressure responsive means responsive to a predetermined pressure within the shifting tool for moving said keys from a first retracted position to open or close said sleeve valve, and means for holding said keys in a second retracted position after said sleeve valve has been opened or closed by the shifting tool and the shifting tool has released from the sleeve valve, said keys held in said first retracted position during the running of the shifting tool into the production tubing, said keys held in said second retracted position during retrieval of the shifting tool and reeled tubing from said production tubing; and (e) two-way valve means on the lower end of the shifting tool for closing the shifting tool passage to flow when pressure is applied in the reeled tubing.

9. The shifting tool of claim 8 wherein the invertible operating means are connected in the shifting tool to close the sliding sleeve valve.

10. The shifting tool of claim 8 wherein the invertible operating means are connected in the shifting tool to open the sliding sleeve valve.

11. The shifting tool of claim 8 further including means therein for releasing the keys from the sliding sleeve valve if the sleeve valve is not completely opened or closed or the keys do not release.

12. The shifting tool of claim 8 further including releasable selective locating means for locating the shifting tool in a sliding sleeve valve.

13. The shifting tool of claim 12 further including quick disconnect means on the upper end of the shifting tool, the two-way valve means being operable in response to a predetermined pressure in the reeled tubing to provide pressure communication between the shifting tool flow passage and the exterior of the shifting tool.

14. The shifting tool of claim 8 wherein the means for attaching the shifting tool to reeled tubing is a threaded connection on the upper end of the shifting tool.

15. The shifting tool of claim 8 wherein pressure responsive means comprise:

(a) an elongate mandrel;

(b) a piston releasably positioned on an slidably sealed around said mandrel to form a variable volume pressure chamber with said mandrel, said piston having an extension;

(c) a cover sealably connected on said mandrel for holding the keys in the first retracted position;
(d) said piston slidably sealed in said cover; and
(e) flow passage means for communicating pressure in the shifting tool flow passage to said pressure chamber.

16. The shifting tool of claim 15 wherein the means for holding the keys in the second retracted position comprise:
(a) a groove around the mandrel;
(b) openings in the piston extension;
(c) a lug mounted for radial movement in each said opening;
(d) a lock sleeve slidably mounted on said mandrel, said lock sleeve having an internal groove engageable by said lugs, said lugs disengaging said lock sleeve groove on movement of said lock sleeve along said mandrel to position said lugs adjacent said mandrel groove where said lock sleeve lugs engage said mandrel groove, locking said lock sleeve to said mandrel; and
(e) said lock sleeve biased toward the second retracted position.

17. The shifting tool of claim 8 wherein the two-way valve means comprise:
(a) an upper housing;
(b) a ball retainer in said upper housing;
(c) a ball valve in said ball retainer;
(d) a lower housing sealably connected to said upper housing;
(e) said lower housing having a seat slidably sealed therein, said ball valve sealingly engageable with said seat;
(f) means releasably positioning said seat in said lower housing;
(g) at least one flow passage through said lower housing below said seat, said flow passage communicating the inside of the two-way valve and shifting tool flow passage with the exterior thereof; and
(h) a guide cap sealingly connected on said lower housing.

18. A system for controlling flow between the interior and the exterior of a well flow conductor at a downhole location in horizontal and highly deviated well conduits comprising:
(a) a sliding sleeve valve connected in the well flow conductor at the downhole location;
(b) means for centralizing said sliding sleeve valve within the well conduit, said centralizing means including upper and lower radial projections on said sleeve valve, each said projection separated by a flow passage;
(c) means providing flow area along the exterior of said sliding sleeve valve;
(d) a pressure operated shifting tool with keys for engaging said sliding sleeve valve, said keys held in a first retracted position during running in and a second retracted position during retrieval of said shifting tool from a well conduit;
(e) means for attaching said shifting tool to reeled tubing; and
(f) means on said shifting tool for releasing said keys from retracted position to engage and open or close said sliding sleeve valve to flow between the exterior and interior thereof in response to fluid pressure within said reeled tubing after said shifting tool has located in said sliding sleeve valve.

19. The system of claim 18 wherein the sliding sleeve valve further includes a number of ports for flow between the exterior and interior thereof and the means providing flow area along the sliding sleeve valve are a number of longitudinal slots on said sleeve valve, each said longitudinal slot aligned with a flow port.

20. The system of claim 19 wherein the flow passages separating the lower projections are aligned with the longitudinal flow slots on the sleeve valve.

21. The system of claim 18 wherein the longitudinal slots on the sleeve valve are of sufficient number, width and length to collect production from a number of well formations.

22. The system of claim 18 wherein the means for attaching the shifting tool to reeled tubing is an emergency disconnect device having a flow passage therethrough for pressure communication between said reeled tubing and said shifting tool.

23. The system of claim 18 wherein the shifting tool includes a mandrel and the means on the shifting tool for releasing the keys comprising:
(a) a piston releasably positioned on an slidably sealed around said mandrel to form a variable volume pressure chamber with said mandrel, said piston having an extension;
(b) retractible keys mounted in expanded position on said piston extension;
(c) a cover sealably connected on said mandrel for holding the keys in the first retracted position;
(d) said piston also slidably sealed in said cover; and
(e) flow passage means for communicating pressure in the shifting, tool flow passage to said pressure chamber.

24. The system of claim 23 wherein the shifting tool further includes means for holding the keys retracted after automatic release from the sleeve valve.

25. The system of claim 24 wherein the means for holding the keys retracted comprise:
(a) a groove around the mandrel;
(b) openings in the piston extension;
(c) a lug mounted for radial movement in each said opening;
(d) a lock sleeve slidably mounted on said mandrel, said lock sleeve having an internal groove engageable by said lugs, said lugs disengaging said lock sleeve groove on movement of said lock sleeve along said mandrel to position said lugs adjacent said mandrel groove where said lock sleeve lugs engage said mandrel groove, locking said lock sleeve to said mandrel; and
(e) said lock sleeve biased toward the holding position position.

26. The system of claim 18 wherein the shifting tool includes selective releasable locator means and the sliding sleeve valve has selective locator recesses therein, said locator means engageable in said locator recesses for locating said shifting tool in said sliding sleeve valve to open or close said sleeve valve.

27. The system of claim 26 wherein the shifting tool further includes two-way valve means connected on the lower end thereof for filling the shifting tool and reeled tubing on lowering into the well conduit, said two-way valve means closing the shifting tool flow passage to outflow when there is pressure in said shifting tool flow passage, said valve means operable at a predetermined higher pressure in said shifting tool flow passage to open a flow passage between said shifting tool flow passage and the exterior of said two-way valve means.

28. The system of claim 27 wherein the shifting tool further includes means operable by a predetermined pull force for releasing the keys from the sliding sleeve valve in the event shifting to open or closed position is not complete and the keys are not automatically released from said sleeve valve.

29. The system of claim 26 wherein complete opening or closing of the sleeve valve is indicated by circulation down reeled tubing from surface through the shifting tool and up inside the sleeve valve to between reeled tubing and production tubing back to surface.

30. The system of claim 18 wherein the shifting tool includes operator means actuated by a predetermined pulling force on the shifting tool to retract and release the keys from the sliding sleeve valve.

31. The system of claim 18 wherein the shifting tool and sliding sleeve valve have cooperable means for automatically releasing the shifting tool keys from engagement with the sleeve valve on complete opening or closing of the sleeve valve.

32. The system of claim 31 wherein the sliding sleeve valve includes upper and lower housings and a sliding sleeve therein, the cooperable means comprising:

(a) a camming surface in each said upper and lower housing;

(b) upper and lower shifting recesses in said sleeve, each said recess having a camming surface; and (c) opposed camming surfaces on the keys, said sleeve longitudinally moveable to engage one of said key opposed camming surfaces with said upper housing camming surface and said upper recess camming surface or said lower housing camming surface and said lower recess camming surface.

33. A system for controlling fluid communication between the interior and the exterior of a well flow conductor at a downhole location in horizontal and highly deviated well conduits comprising:

(a) a sliding sleeve valve connected in the well flow conductor at the downhole location, said sliding sleeve valve including an upper housing having projections thereon, said projection having flow passages therethrough, said upper housing further including selective locator recesses, an upper camming surface, upper and lower positioning grooves, and a seal bore therein, a lower housing connected on said upper housing, said lower housing having projections separated by flow passages and flow slots thereon aligned with said projection flow passages, said lower housing further including ports therethrough and a seal bore therein, each said port aligned with a flow slot on said lower housing, a sliding sleeve moveable between an upper open position, permitting flow through said ports, and a lower closed position, closing said ports to flow, said sliding sleeve having biased lugs and seals thereon, said lugs releasably engageable in said upper housing upper or lower positioning grooves and said seal sealingly engageable in said upper or lower housing seal bores, said sliding sleeve further including upper and lower shifting recesses each having a camming surface; and (b) a shifting tool including, quick disconnect means for connecting and disconnecting said shifting tool to and from reeled tubing, selective releasable locator means engageable with said upper housing locator recesses for releasably locating said shifting tool in said sliding sleeve valve to move said sliding sleeve between open and closed positions, invertible operating means including a mandrel and keys, said keys having opposed camming surfaces, said invertible operating means including means on said mandrel for holding said keys in retracted position while running said shifting tool into said production tubing, means releasably positioned and slidably mounted on said mandrel, said releasable means responsive to pressure in said shifting tool for releasing said keys from retracted position to engage said upper or lower sleeve shifting recesses, said keys having opposed camming surfaces engageable with said upper housing and said upper sleeve recess camming surfaces or said lower housing and said lower sleeve recess camming surface for automatically retracting and releasing said keys from said upper or lower sleeve shifting recess on complete movement of said sliding sleeve to open or closed position, means on said mandrel operated by a predetermined pull force on said shifting tool for retracting and releasing said keys from said upper or lower sleeve recess and holding said keys retracted on incomplete movement of said sliding sleeve toward open or closed position, means slidably mounted on said mandrel for holding said keys retracted for retrieval of said shifting tool after automatic retraction and release of said keys from said upper or lower sleeve shifting recess, and two-way valve means sealably connected on the lower end of said mandrel, said two-way valve permitting said shifting tool and reeled tubing to fill with fluid on being lowered into said production tubing, said two-way valve means operable to open a flow passage between the interior and exterior of said shifting tool.

* * * * *